US007918364B2

(12) United States Patent
Kim et al.

(10) Patent No.: US 7,918,364 B2
(45) Date of Patent: Apr. 5, 2011

(54) DISPOSABLE TEACUP SHAPE PAPER CUP HOLDER

(76) Inventors: Jae Eun Kim, Los Angeles, CA (US); Seung Wook Son, Los Angeles, CA (US)

( * ) Notice: Subject to any disclaimer, the term of this patent is extended or adjusted under 35 U.S.C. 154(b) by 539 days.

(21) Appl. No.: 12/106,037

(22) Filed: Apr. 18, 2008

(65) Prior Publication Data

US 2009/0261117 A1 Oct. 22, 2009

(51) Int. Cl.
*B65D 25/22* (2006.01)

(52) U.S. Cl. ..... 220/738; 220/737

(58) Field of Classification Search ..... 220/737, 220/738, 903

See application file for complete search history.

(56) References Cited

U.S. PATENT DOCUMENTS 1,113,618 A * 10/1914 Haldeman ..... 220/738
2,558,287 A * 6/1951 Amberg ..... 229/402
4,678,154 A * 7/1987 McFarland ..... 248/311.2
5,425,497 A * 6/1995 Sorensen ..... 220/738
5,454,484 A * 10/1995 Chelossi ..... 220/738
5,868,310 A * 2/1999 Leszczynski ..... 229/402
6,557,751 B2 * 5/2003 Puerini ..... 229/402

* cited by examiner

*Primary Examiner* — Stephen Castellano

(74) *Attorney, Agent, or Firm* — John K. Park; Park Law Firm

(57) ABSTRACT

A paper cup holder having a disposable teacup shape for a cup is provided. The paper cup holder includes inner and outer lining portions, finger portions, intermediate supporting portions, first and second half crossing cuts, and fastening portions. The inner lining portion wraps around the cup. The outer lining portion is provided around the inner lining portion, and the outer lining portion is configured to wrap around the inner lining portion so as to shield heat from the cup, and wherein the out lining portion comprises first and second edges. The finger hole portions accept one or two fingers. The intermediate supporting surface is provided between the finger hole portions.

16 Claims, 7 Drawing Sheets

DISPOSABLE TEACUP SHAPE PAPER CUP HOLDER

BACKGROUND OF THE INVENTION

The present invention relates to a disposable teacup shape paper cup holder. More particularly, this invention relates to a disposable teacup shape paper cup holder, which helps to hold a hot cup.

Hot beverage is popular even in hot summer. At home or a commercial store, hot beverage is served with a cup which is specialized for handling with the situation.

Cup holder is one of the good measures to help people to hold otherwise too hot a cup to hold. Several kinds of cup holder have been suggested, not with a hundred percent of satisfaction.

A cup holder of a prior art does not insulates enough heat from the cup. Other cup holder of certain prior arts provide a good insulation, but the manufacturing or serving cost is too high.

Accordingly, a need for a disposable teacup shape paper cup holder with a good insulating and low manufacturing cost has been present for a long time considering the popularity of hot drinks. This invention is directed to satisfy the long-felt need.

SUMMARY OF THE INVENTION

An objective of the invention is to provide a disposable teacup shape paper cup holder.

Another object of the invention is to provide a disposable teacup shape paper cup holder, which can be manufactured easily with reduced steps.

Still another object of the invention is to provide a disposable teacup shape paper cup holder, which has a tough structure and makes it easy to hold a hot cup.

An aspect of the invention provides a disposable teacup shape paper cup holder. The disposable teacup shape paper cup holder includes An aspect of the invention provides a paper cup holder having a disposable teacup shape for a cup.

The paper cup holder comprises an inner lining portion, an outer lining portion, one or more finger portions, an intermediate supporting portions, a first half crossing cut, a second half crossing cut, and one or more fastening portions.

The inner lining portion is configured to wrap around the cup, and the inner lining portion comprises first and second edges.

The outer lining portion is provided around the inner lining portion, and the outer lining portion is configured to wrap around the inner lining portion so as to shield heat from the cup, and wherein the out lining portion comprises first and second edges.

The finger hole portions are configured to accept one or two fingers to hold a cup, and each of the finger hole portions is provided in at least a part of the outer lining portion.

The intermediate supporting surface is provided between the one or more finger hole portions, and the intermediate supporting surface is configured to support the outer lining portion and the one or more finger hole portions in place against force applied sideways.

The first half crossing cut is provided at the first edge of the inner lining portion along a bottom part of the inner lining portion.

The second half crossing cut is provided at the second edge of the inner lining portion along a top part of the outer lining portion, and the second half crossing cut is intertwined with the first half crossing cut so as to close the first and second edges of the inner lining portion and provide continuous connection between the inner and outer lining portions.

The fastening portions are provided in each of the first and second edges of the outer lining portion, and the one or more fastening portions are configured to close the first and second edges of the outer lining portion. The paper cup holder is formed by a single piece of a base sheet.

The base sheet may comprise a plurality of sections, and two neighboring sections may be separated by a folding line.

The plurality sections may comprise: a central section having first and second edges; a first intermediate section extended from the first edge of the central section; a second intermediate section extended from the second edge of the central section; a first end section extended from the first intermediate supporting surface section; and a second end section extended from the second intermediate supporting surface section.

The central section may comprises: the inner lining portion; the first and second half crossing cuts; one or more sub-portions of the outer lining portion; a first two finger hole portions, each of which being disposed at one of the first and second edges.

The central section may comprises a part of radial strip, and the part of radial strip may be configured to be wrapped by more than 360 degrees to form a part of a cone close to a base of the cone.

The first and second end sections may comprise a second two finger hole portions, each of which being disposed substantially symmetrically with the first two finger hole portions about one of the first and second intermediate sections.

The first two finger hole portions may be configured to match with the second two finger hole portions. Each of the first and second finger hole portions may be configured to insert at least one finger, or at least two fingers.

Each of the first and second intermediate sections may comprise one of the intermediate supporting surface, and the first and second intermediate sections may be configured to be overlapped. Each of the first and second intermediate sections may have a shape of a long equilateral triangle.

The first and second end sections may comprise a second two finger hole portions, each of which being disposed substantially symmetrically with the first two finger hole portions about one of the first and second intermediate sections.

The first two finger hole portions may be configured to match with the second two finger hole portions. Each of the first and second finger hole portions may be configured to insert one or more fingers.

Each of the first and second end sections may comprise one of the one or more fastening portions. The one of the one or more fastening portions may comprise glue.

The advantages of the present invention are: (1) the disposable teacup shape paper cup holder is simple enough to make it fast and cheap to manufacture; and (2) the disposable teacup shape paper cup holder is tough in spite of the simple structure.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
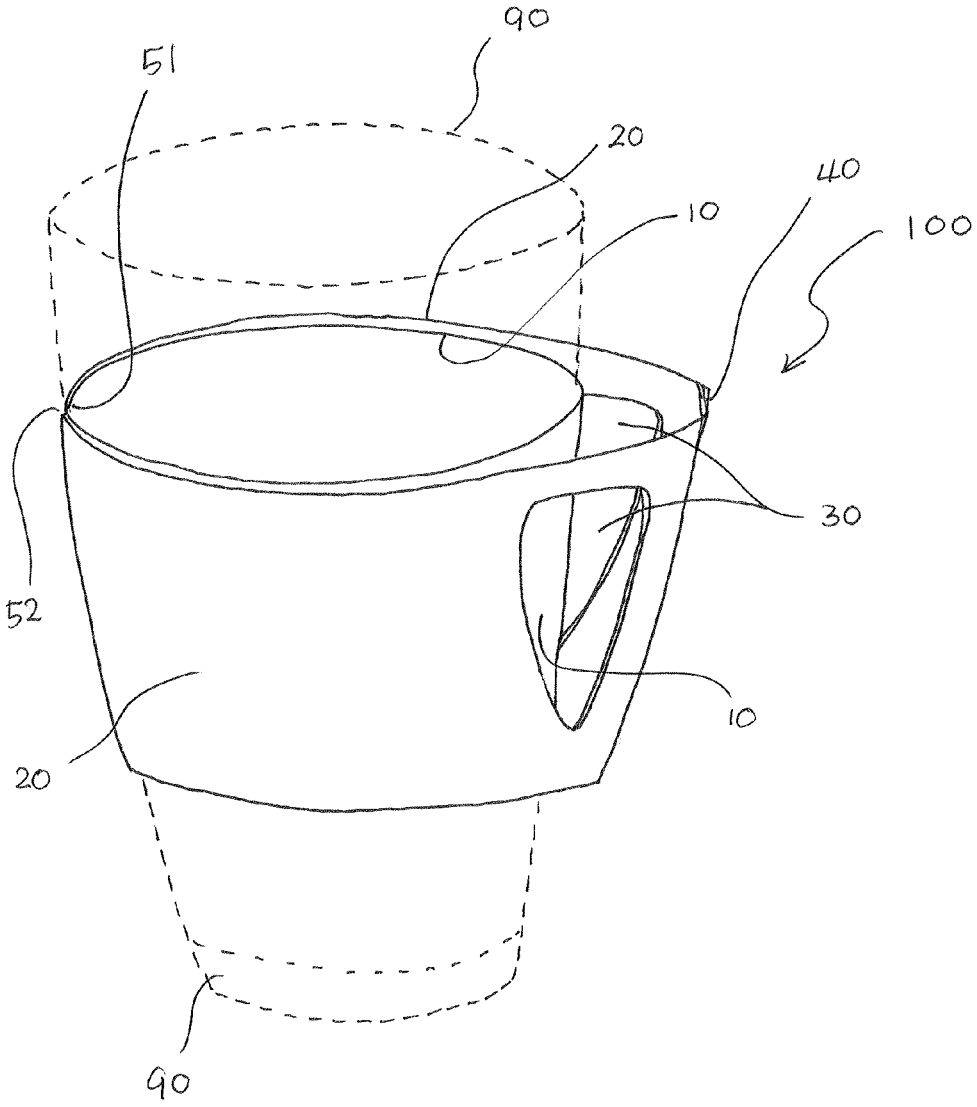
FIG. 1 is perspective view of a disposable teacup shape paper cup holder according to an embodiment of the invention.

FIGS. 1-5 show disposable teacup shape paper cup holders 100 according to the present invention.

An aspect of the invention provides the paper cup holder 100 having a disposable teacup shape for a cup 90.

The paper cup holder 100 comprises an inner lining portion 10, an outer lining portion 20, one or more finger portions 30, an intermediate supporting portions 40, a first half crossing cut 51, a second half crossing cut 52, and one or more fastening portions 60.

Figure 4:
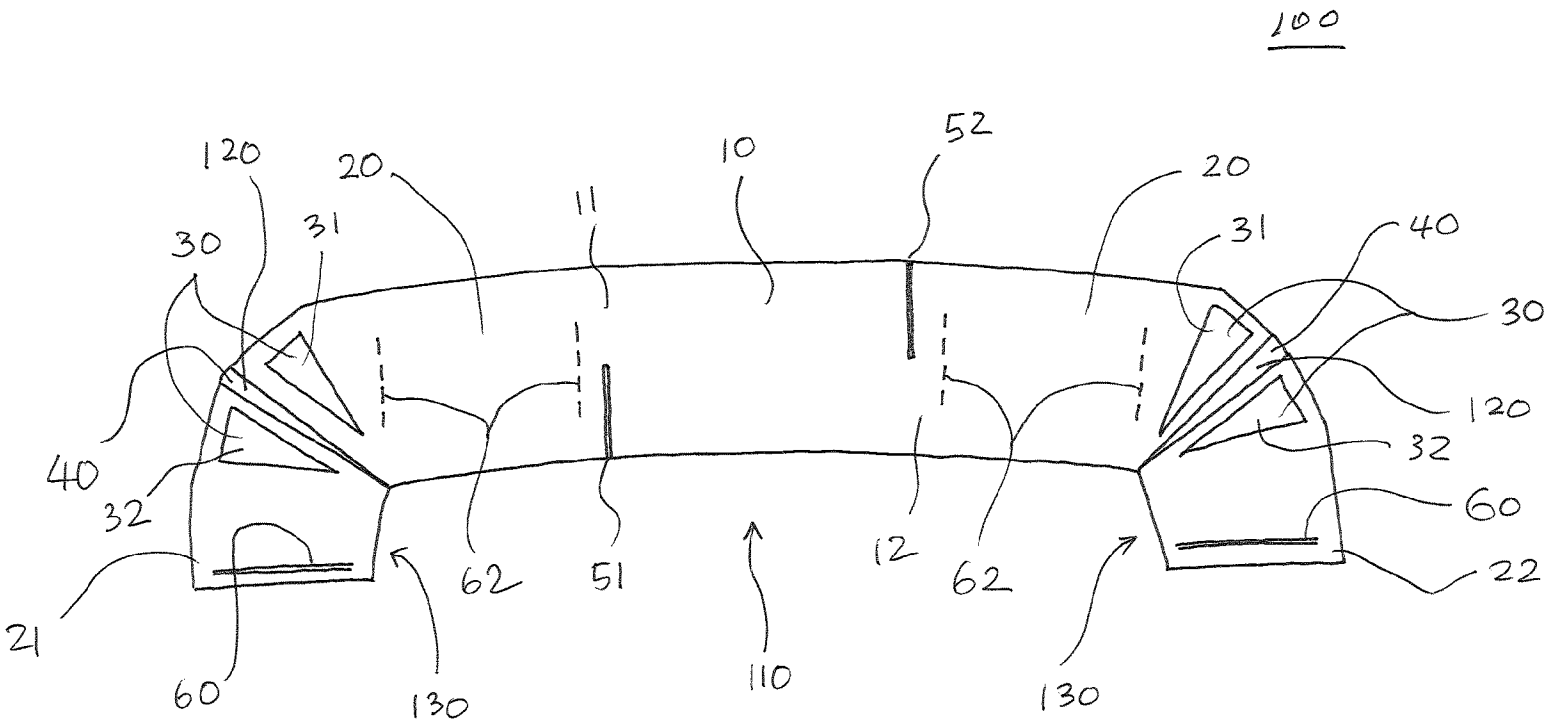
FIG. 4 is a spread view of the paper cup holder of FIG. 1.

The inner lining portion 10 is configured to wrap around the cup 90, and the inner lining portion 10 comprises first and second edges 11, 12 as shown in FIG. 4.

The outer lining portion 20 is provided around the inner lining portion 10, and the outer lining portion 20 is configured to wrap around the inner lining portion 10 so as to shield heat from the cup 90, and the outer lining portion 20 comprises first and second edges 21, 22 as shown in FIG. 4.

Figure 5:
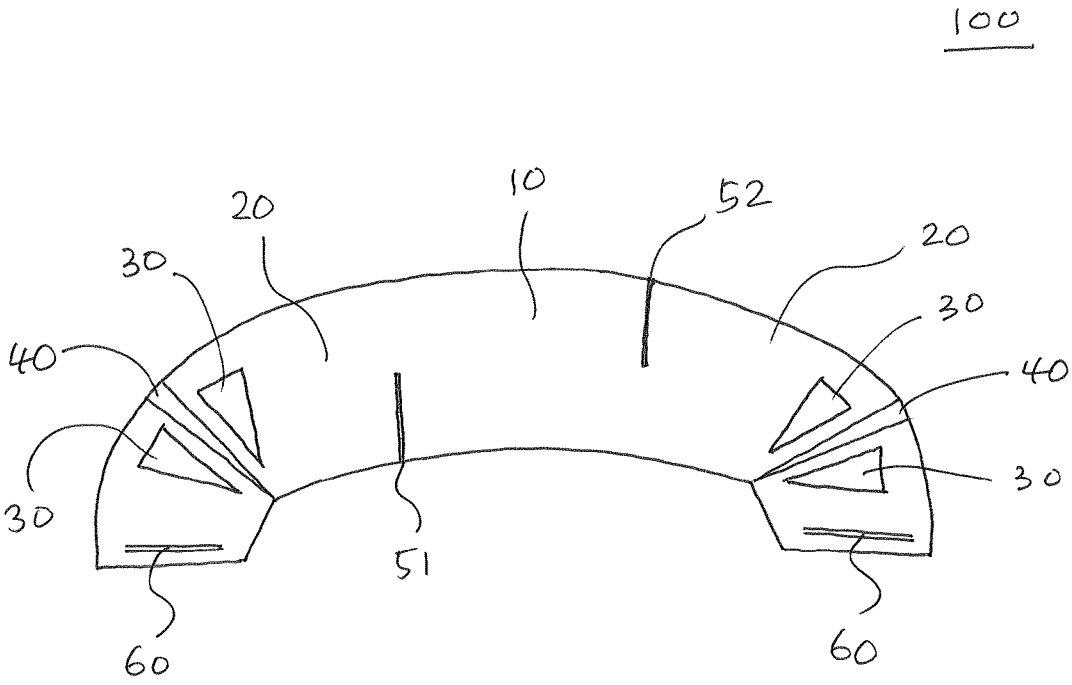
FIG. 5 is another spread view of a paper cup holder according to another embodiment of the invention.

The finger hole portions 30 are configured to accept one or two fingers to hold the cup 90, and each of the finger hole portions 30 is provided in at least a part of the outer lining portion 20 as shown in FIGS. 4 and 5.

The intermediate supporting surface 40 is provided between the one or more finger hole portions 30, and the intermediate supporting surface 40 is configured to support the outer lining portion 20 and the one or more finger hole portions 30 in place against force applied sideways.

The first half crossing cut 51 is provided at the first edge 11 of the inner lining portion 10 along a bottom part of the inner lining portion 10.

Figure 6:
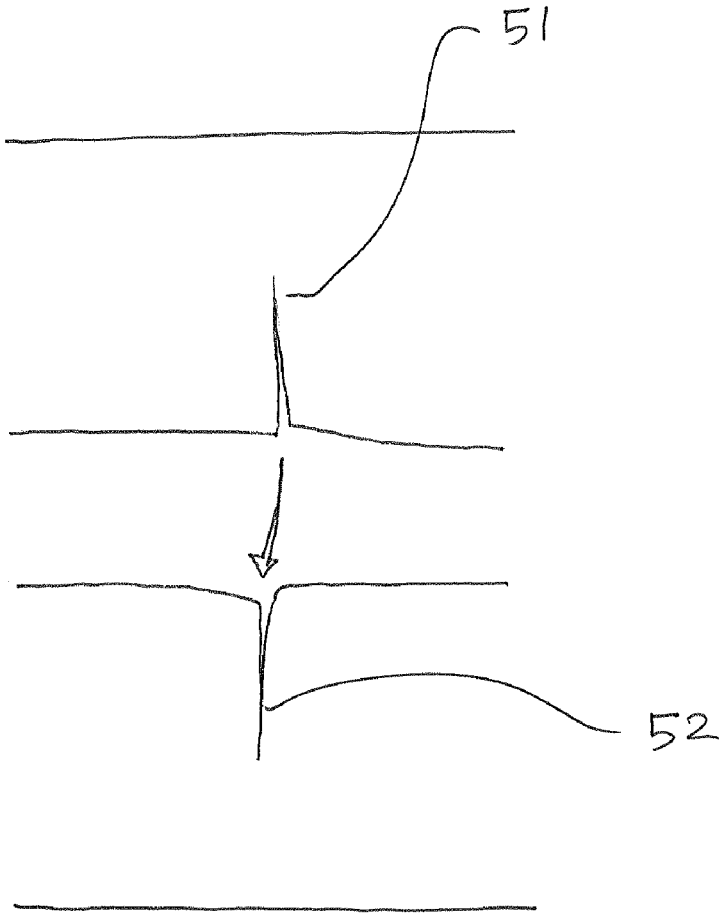
FIG. 6 is an assembly diagram illustrating intertwining of two half crossing cuts.
Figure 7:
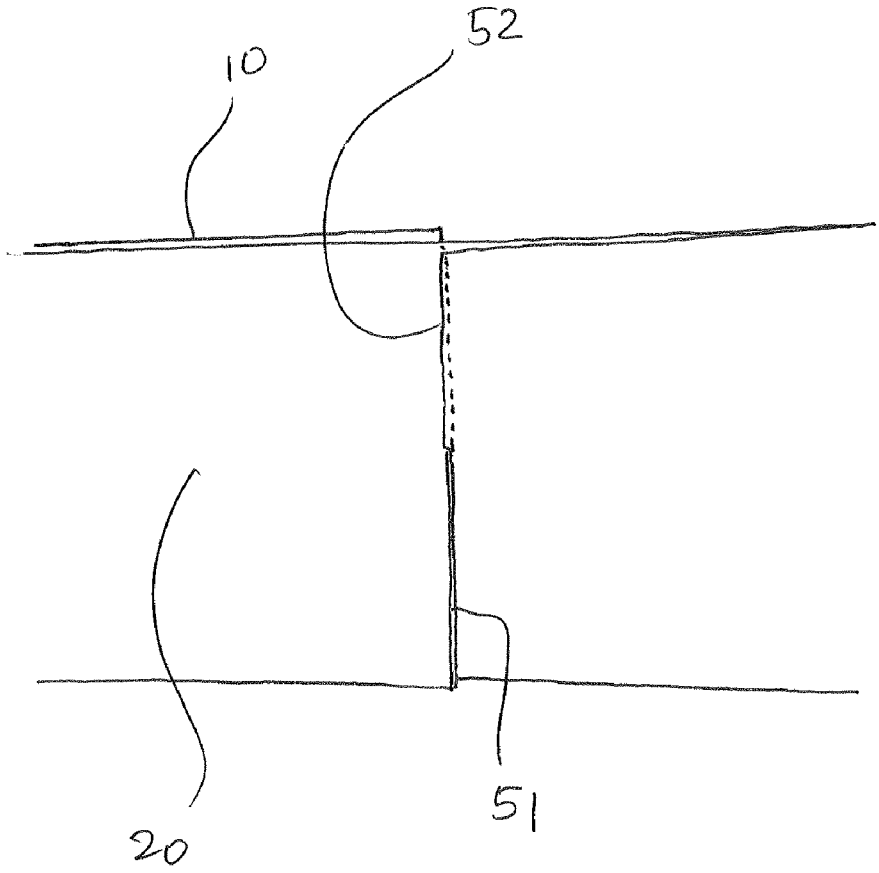
FIG. 7 is a perspective view illustrating two assembled half crossing cuts of FIG. 6.

The second half crossing cut 52 is provided at the second edge 12 of the inner lining portion 10 along a top part of the outer lining portion 20, and the second half crossing cut 52 is intertwined with the first half crossing cut 51 so as to close the first and second edges 51, 52 of the inner lining portion 10 and provide continuous connection between the inner and outer lining portions 10, as shown in FIGS. 6 and 7.

The fastening portions 60 are provided in each of the first and second edges 21, 22 of the outer lining portion 20, and the one or more fastening portions 60 are configured to close the first and second edges 21, 22 of the outer lining portion 20. The paper cup holder 100 is formed by a single piece of a base sheet as shown in FIGS. 4 and 5. In the illustrated embodiment, the paper cup holder 100 may include more fastening portions 62 as shown in FIG. 4. The fastening portions 62 may include glue.

The base sheet in FIGS. 4 and 5 may comprise a plurality of sections, and two neighboring sections may be separated by a folding line.

The plurality sections may comprise: a central section 110 having first and second edges; a first intermediate section 120 extended from the first edge of the central section 110; a second intermediate section 120 extended from the second edge of the central section 110; a first end section 130 extended from the first intermediate supporting surface section 120; and a second end section 130 extended from the second intermediate supporting surface section 120.

The central section 110 may comprises: the inner lining portion 10; the first and second half crossing cuts 51, 52; one or more sub-portions of the outer lining portion 20; a first two finger hole portions 31, each of which being disposed at one of the first and second edges as shown in FIG. 4.

The central section 110 may comprises a part of radial strip, and the part of radial strip may be configured to be wrapped by more than 360 degrees to form a part of a cone close to a base of the cone as shown in FIGS. 1 and 5.

The first and second end sections 130 may comprise a second two finger hole portions 32, each of which being disposed substantially symmetrically with the first two finger hole portions about one of the first and second intermediate sections as shown in FIG. 4.

Figure 2:
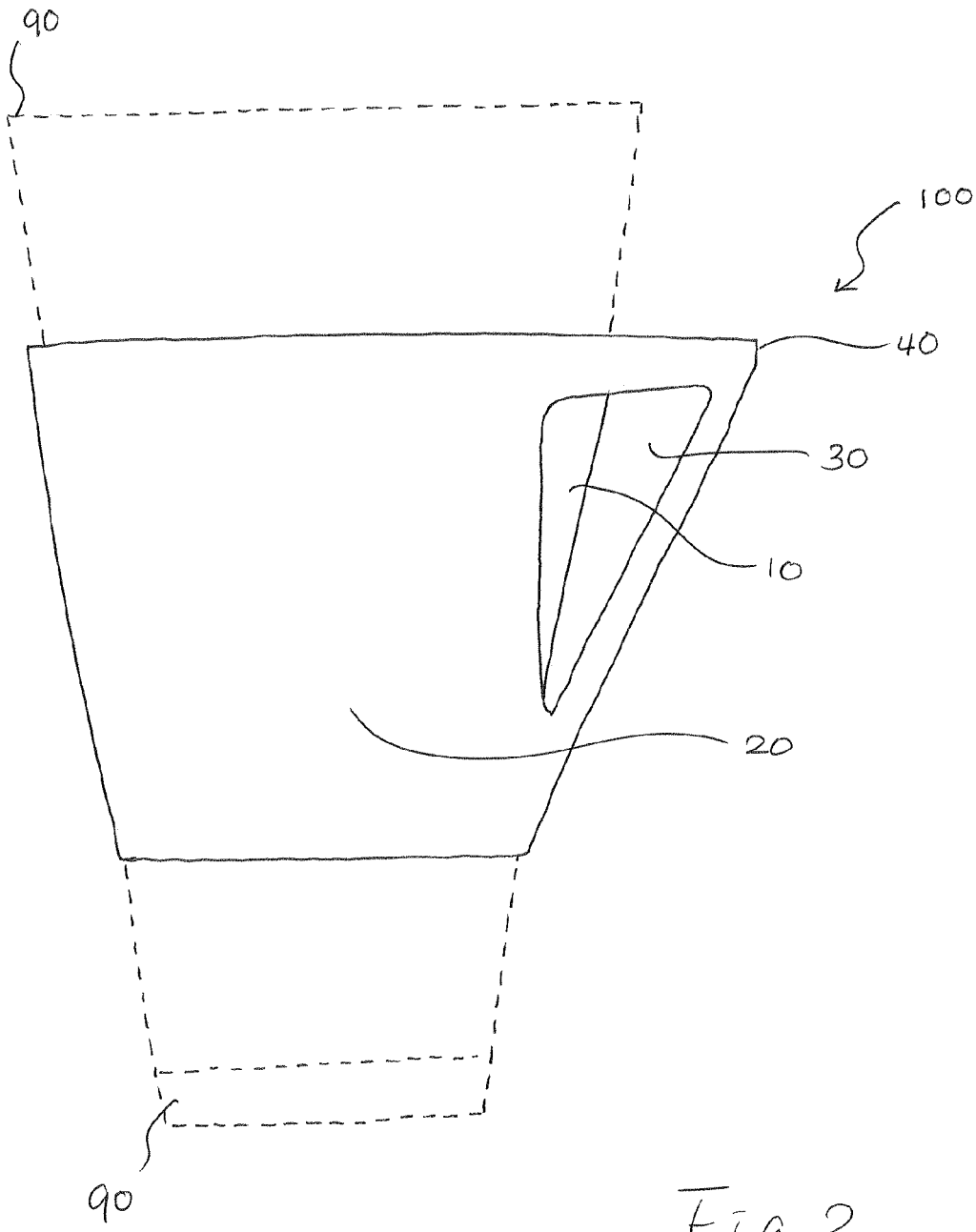
FIG. 2 is a front plan view of the paper cup holder of FIG. 1.
Figure 3:
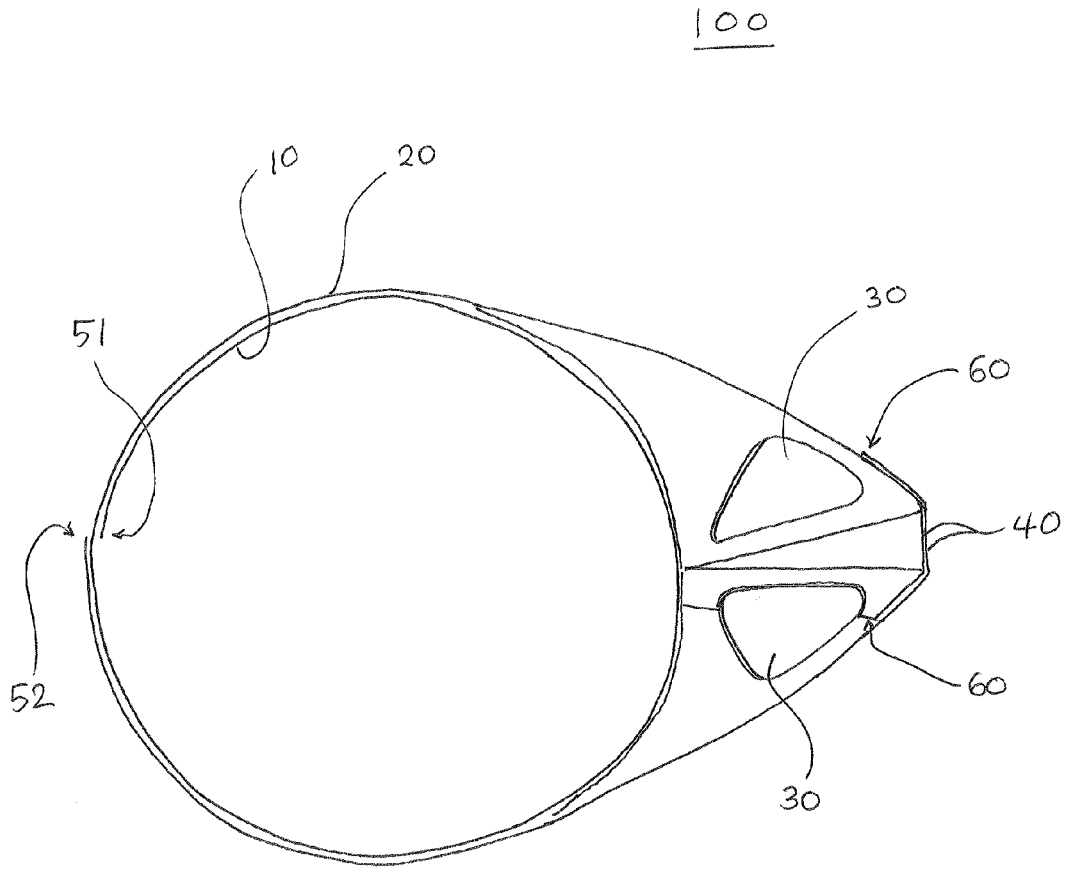
FIG. 3 is a top plan view of the paper cup holder of FIG. 1.

The first two finger hole portions 31 may be configured to match with the second two finger hole portions 32. The finger hole portions 31, 32 are overlapped in assembling as shown in FIGS. 1 to 3. Each of the first and second finger hole portions 31, 32 may be configured to insert at least one finger, or at least two fingers.

Each of the first and second intermediate sections 120 may comprise one of the intermediate supporting surface 40, and the first and second intermediate sections 120 may be configured to be overlapped. Each of the first and second intermediate sections 120 may have a shape of, but not limited to, a long equilateral triangle.

The first and second end sections 130 may comprise a second two finger hole portions 32, each of which being disposed substantially symmetrically with the first two finger hole portions 31 about one of the first and second intermediate sections 120.

The first two finger hole portions 31 may be configured to match with the second two finger hole portions 32. Each of the first and second finger hole portions 31, 32 may be configured to insert one or more fingers.

Each of the first and second end sections 130 may comprise one of the one or more fastening portions 60, 62. The one of the one or more fastening portions 60, 62 may comprise glue. Alternatively, the fastening portions 60, 62 may comprise a hook and a slot (not shown).

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A paper cup holder having a disposable teacup shape for a cup comprising:

an inner lining portion configured to wrap around the cup, wherein the inner lining portion comprises first and second edges;

an outer lining portion provided around the inner lining portion, wherein the outer lining portion is configured to wrap around the inner lining portion so as to shield heat from the cup, and wherein the out lining portion comprises first and second edges;

one or more finger hole portions configured to accept one or two fingers to hold a cup, wherein each of the one or more finger hole portions is provided in at least a part of the outer lining portion;

an intermediate supporting surface provided between the one or more finger hole portions, the intermediate supporting surface being configured to support the outer lining portion and the one or more finger hole portions in place against force applied sideways;

a first half crossing cut provided at the first edge of the inner lining portion along a bottom part of the inner lining portion;

a second half crossing cut provided at the second edge of the inner lining portion along a top part of the outer lining portion, wherein the second half crossing cut is intertwined with the first half crossing cut so as to close the first and second edges of the inner lining portion and provide continuous connection between the inner and outer lining portions; and one or more fastening portions provided in each of the first and second edges of the outer lining portion, wherein the one or more fastening portions is configured to close the first and second edges of the outer lining portion, wherein the paper cup holder is formed by a single piece of a base sheet.

2. The paper cup holder of claim 1, wherein the base sheet comprises a plurality of sections, and wherein two neighboring sections are separated by a folding line.

3. The paper cup holder of claim 2, wherein the plurality sections comprise:

a central section having first and second edges;

a first intermediate section extended from the first edge of the central section;

a second intermediate section extended from the second edge of the central section;

a first end section extended from the first intermediate supporting surface section; and a second end section extended from the second intermediate supporting surface section.

4. The paper cup holder of claim 3, wherein the central section comprises:

the inner lining portion;

the first and second half crossing cuts;

one or more sub-portions of the outer lining portion;

a first two finger hole portions, each of which being disposed at one of the first and second edges.

5. The paper cup holder of claim 4, wherein the central section comprises a part of radial strip, and wherein the part of radial strip is configured to be wrapped by more than 360 degrees to form a part of a cone close to a base of the cone.

6. The paper cup holder of claim 4, wherein the first and second end sections comprise a second two finger hole portions, each of which being disposed substantially symmetrically with the first two finger hole portions about one of the first and second intermediate sections.

7. The paper cup holder of claim 6, wherein the first two finger hole portions are configured to match with the second two finger hole portions.

8. The paper cup holder of claim 7, wherein each of the first and second finger hole portions is configured to insert at least one finger.

9. The paper cup holder of claim 7, wherein each of the first and second finger hole portions is configured to insert at least two fingers.

10. The paper cup holder of claim 3, wherein each of the first and second intermediate sections comprises one of the intermediate supporting surface, wherein the first and second intermediate sections are configured to be overlapped, and wherein each of the first and second intermediate sections has a shape of a long equilateral triangle.

11. The paper cup holder of claim 3, wherein the first and second end sections comprise a second two finger hole portions, each of which being disposed substantially symmetrically with the first two finger hole portions about one of the first and second intermediate sections.

12. The paper cup holder of claim 3, wherein the first two finger hole portions are configured to match with the second two finger hole portions.

13. The paper cup holder of claim 12, wherein each of the first and second finger hole portions is configured to insert one or more fingers.

14. The paper cup holder of claim 2, wherein each of the first and second end sections comprises one of the one or more fastening portions.

15. The paper cup holder of claim 14, wherein one of the one or more fastening portions comprises glue.

16. The paper cup holder of claim 14, wherein each of the one or more fastening portions comprises glue.

* * * * *